US006004439A

United States Patent [19]

Bakhir et al.

[11] Patent Number: 6,004,439

[45] Date of Patent: Dec. 21, 1999

[54] APPARATUS FOR OBTAINING PRODUCTS BY ANODE OXIDATION OF DISSOLVED CHLORIDES OF ALKALINE OR ALKALINE-EARTH METALS

[76] Inventors: Vitold M. Bakhir, ulitsa Svobody, 47, kv.81; Jury G. Zadorozhny, Ryazansky prospekt, 54 kv.95, both of Moscow, Russian Federation

[21] Appl. No.: 09/044,951

[22] Filed: Mar. 19, 1998

Related U.S. Application Data

[60] Provisional application No. 60/041,063, Mar. 19, 1997.

[51] Int. Cl.[6] ..... C25B 9/00; C25C 7/00; C25D 17/00

[52] U.S. Cl. ..... 204/260; 204/263; 204/272; 204/275

[58] Field of Search ..... 204/260, 263, 204/295, 272, 275

[56] References Cited

U.S. PATENT DOCUMENTS

| | | | |
|---|---|---|---|
| 3,661,762 | 5/1972 | Parsi | 205/348 |
| 4,432,856 | 2/1984 | Murakami et al. | 204/237 |
| 4,981,563 | 1/1991 | Spaziante et al. | 204/633 |
| 5,427,667 | 6/1995 | Bakhir et al. | 204/260 |

*Primary Examiner*—Bruce F. Bell
*Assistant Examiner*—Wesley A. Nicolas
*Attorney, Agent, or Firm*—John Edward Roethel

[57] ABSTRACT

An electrochemical cell or a plurality or block of electrochemical cells is connected through an anode circulation system to a reservoir which is also provided with a built-in controller for maintaining the level of anolyte. The built-in controller can be any suitable regulation device that controls the speed at which the brine is pumped into the anode chamber. A valve-type device is provided on the reservoir for releasing the gaseous mixture of the oxidants to maintain a given pressure in the anode circulation system. The cathode circulation system also includes a reservoir which also includes a valve-type device for the discharge of the excess gas-liquid mixture. A feed unit which contains a pump and a brine tank is connected to the lower part of the anode circulation system. A gas separator for separating hydrogen from the alkaline solution (the catholyte) is also connected to the system.

5 Claims, 5 Drawing Sheets

APPARATUS FOR OBTAINING PRODUCTS BY ANODE OXIDATION OF DISSOLVED CHLORIDES OF ALKALINE OR ALKALINE-EARTH METALS

CROSS-REFERENCE TO RELATED APPLICATION

This application is based on Provisional Application Ser. No. 60/041,063, filed Mar. 19, 1997, entitled "Apparatus for Obtaining Products by Anode Oxidation of Dissolved Chlorides of Alkaline or Alkaline-Earth Metals."

This invention relates to the area of chemical technology, and more particularly to an apparatus for the diaphragm electrolysis of dissolved chlorides of alkaline or alkaline-earth metals (brine). The invention can be used for obtaining gaseous products such as chlorine and oxygen which can then be used to treat water or water-containing solutions for many purposes such as disinfection.

BACKGROUND OF THE INVENTION

In the field of applied electrochemistry, various designs of electrolyzers including a diaphragm have been used for obtaining products by the anode oxidation of brine. The most widely used electrolyzers for this purpose contain an asbestos-based diaphragm. For example, see USSR Author Certificate N. 669764, dated 1976.

The main disadvantage of using an asbestos diaphragm is its relatively short useful life. The characteristics of these asbestos diaphragms also change over time, which requires special steps (such as special additives in the brine, a differential between the level of anolyte and catholyte, etc.) to maintain a stable regime for the electrolysis. Another disadvantage of using an asbestos diaphragm is the low purity obtained in the end products.

High purity end products of the electrolysis of brine can be obtained by using an ion-exchange membrane. For example, see USSR Author Certificate N. 1823884, dated 1988. However, using an ion-exchange membrane requires a careful purification of brine which adds additional expenses to the procedure. Power consumption for ion-exchange membranes is also high.

The most similar technology to the present invention is a device used for obtaining anode-oxidized products (including gases). Such a device contains electrodes that are nonsoluble during the electrolysis and such device also uses a cylindrical ceramic diaphragm. The cylindrical ceramic diaphragm can be manufactured, for instance, from non-enameled porcelain (see USSR Patent N. 43585, dated 1940) and the placement of the cylindrical ceramic diaphragm divides the inter-electrode space in the electrode chambers.

This device also contains structure for the circulation of brine through the electrode chambers and structure for removing the end products created during the use of the apparatus.

The beneficial characteristics of ceramic diaphragms are known. For instance, ceramic diaphragms keep their form during use and ceramic diaphragms possess high chemical resistance. However, they have been used only in laboratory-type electrolyzers due to high power consumption required. Ceramic diaphragms are displaced for industrial application by other types of diaphragms, for instance, by MIPOLAM® (a product of Huls Troisdorf Aktiengesellschaft) (a polymeric membrane).

The object of the present invention is to provide a simplified design of the apparatus and to make it possible to obtain high current efficiency of the gaseous products by the electrolysis of water-dissolved chloride of alkaline or alkaline-earth metals. It is a further object of the present invention to reduce the power consumption of the apparatus during use and to increase the service life of the apparatus as well as to make it possible to assemble an apparatus with required production capacity by putting together a number of cells. The end product produced using the apparatus of the present invention can be obtained either as a mixture of gases or as water-dissolved oxidants.

SUMMARY OF THE INVENTION

The apparatus of the present invention contains at least one electrochemical cell made from vertical cylindrical coaxial parts comprising an internal electrode of variable section, an external electrode (made from material that is nonsoluble during electrolysis) and a coaxial ceramic diaphragm (made from materials having as their base zirconium oxides with additives of aluminum and yttrium oxides) which separates the inter-electrode space in the electrode chambers. (See U.S. Pat. No. 5,635,040, issued Jun. 3, 1997, entitled "Electrochemical Cell", the disclosure of which is incorporated herein by reference).

Each electrode chamber is connected to a solution circulation system. The apparatus also contains structure for the discharge of the end products and a feed unit for feeding an anode system with the brine solution. The feed unit is connected to the anode circulation system at its lower part where the hydrostatic pressure is at its maximum for the system. The outlet from the anode circulation system is provided with an apparatus for adjusting and holding pressure inside the anode circulation system. The anode circulation system also contains a reservoir which is placed above the cell at a distance from the anode chamber outlet within 0.5–2.0 lengths of the anode chamber. The volume of the reservoir can vary from 20 to 100 times the volume of the anode chamber of the cell or the total volume of the anode chambers of cells. If the reservoir is placed closer than the 0.5 length of the anode chamber from the outlet and if the reservoir has a volume smaller than 20 times the volume of the anode chamber, then the conditions of circulation worsen since there appears a possibility for the bubbles of gases to be carried away with the flow which reduces the efficiency of the process of electrolysis and increases the power consumption of the device.

Placing the reservoir more than 2.0 lengths of the anode chamber from the outlet and increasing the volume of the reservoir over the limits specified in a formula also makes the conditions of circulation worse since these operating parameters would increase the hydraulic resistance of the system. The reservoir contains an adjustment in its upper part for the maintenance of a constant level of the anolyte and for releasing the electrolytic gases from the reservoir to maintain the constant pressure in the circulation system.

The cathode circulation system also contains a reservoir which is placed between the cathode chamber outlet and the reservoir of the anode circulation system. The volume of the cathode reservoir can be varied from 30 to 200 times the volume of the cathode chamber or the total volume of the cathode chambers if multiple cathode chambers are used. The cathode reservoir is provided with a connecting pipe for discharging the products of the cathode treatment (a mixture of liquid and gas). A connecting pipe is placed in the upper part of the cathode reservoir and is connected to the gas separator. The apparatus is provided with facilities for hydraulically joining in parallel the required number of cells.

The apparatus can also contain a blender which is connected by means of special lines with the source of water as well as with the liquid output of the gas separator and the blender also contains an adjustment for releasing the electrolytic gases from the anode reservoir.

The inlet into the anode circulation system is in its lowest part so that the fresh brine fed into the cell is fed under the maximum hydrostatic pressure. This makes it possible to feed the cell with the fresh brine without breaking a formed mode of gaslift circulations, since fresh brine is introduced into that part of the circulation system which contains the degasified solution. The temperature differential between the circulated solution (warm) and the fresh brine (cold) also helps improve the circulation.

In order to maintain the process of electrolysis in the optimum mode, it is necessary to maintain a constant pressure in the anode chamber and in the anode circulation system. That is why the feed unit and the structure for releasing the electrolytic gases from the anode chamber are provided with controls for the automatic maintenance of a given pressure in the anode circulation system. Furthermore, the anode reservoir contains a device for controlling the level of anolyte. This control device is connected to the feed unit in order to maintain the constant level of the anolyte in the reservoir.

The volume of the reservoir of the cathode circulation system is larger due to the higher volume of gases released from the cathode chamber. If the volume of the reservoir of the cathode circulation system were smaller than 30 times the volume of the cathode chamber (or the total volume of cathode chambers if more than one is used) or if the volume of the reservoir of the cathode circulation system is larger than 200 times the volume of the cathode chamber (or the total volume of the cathode chambers if more than one is used), the circulation in the system falls below acceptable levels. Disposing the cathode reservoir between the cathode chamber outlet and a reservoir of the anode circulation system provides a compact design and optimal working conditions for the apparatus. Providing the apparatus with the blender which is connected by means of special lines with the source of water as well as with the liquid output of the gas separator and with the anode reservoir makes it possible to obtain not only a gaseous mixture but also water solutions of the oxidants. Composition and features of these solutions are defined by the quantity of the anode products and the cathode products which flow through the blender.

The apparatus of the present invention can be used for the treatment of polluted water. In this case, polluted water flows through the blender (on the drawing shown as a source of water).

The facilities for hydraulically joining in parallel the required number of cells can be executed in the manner of collectors which have a main axial channel and a plurality of radial channels to supply and discharge, respectively, the treated brine and the products of the electrolysis into and from the chambers of each cell. Other designs for joining several cells to obtain a required production capacity are also acceptable; for example, the apparatus disclosed in Russian Patent No 2042639.

Other objects of the present invention will become apparent from a consideration of the following detailed description.

DETAILED DESCRIPTION OF THE PREFERRED EMBODIMENTS

Figure 1:
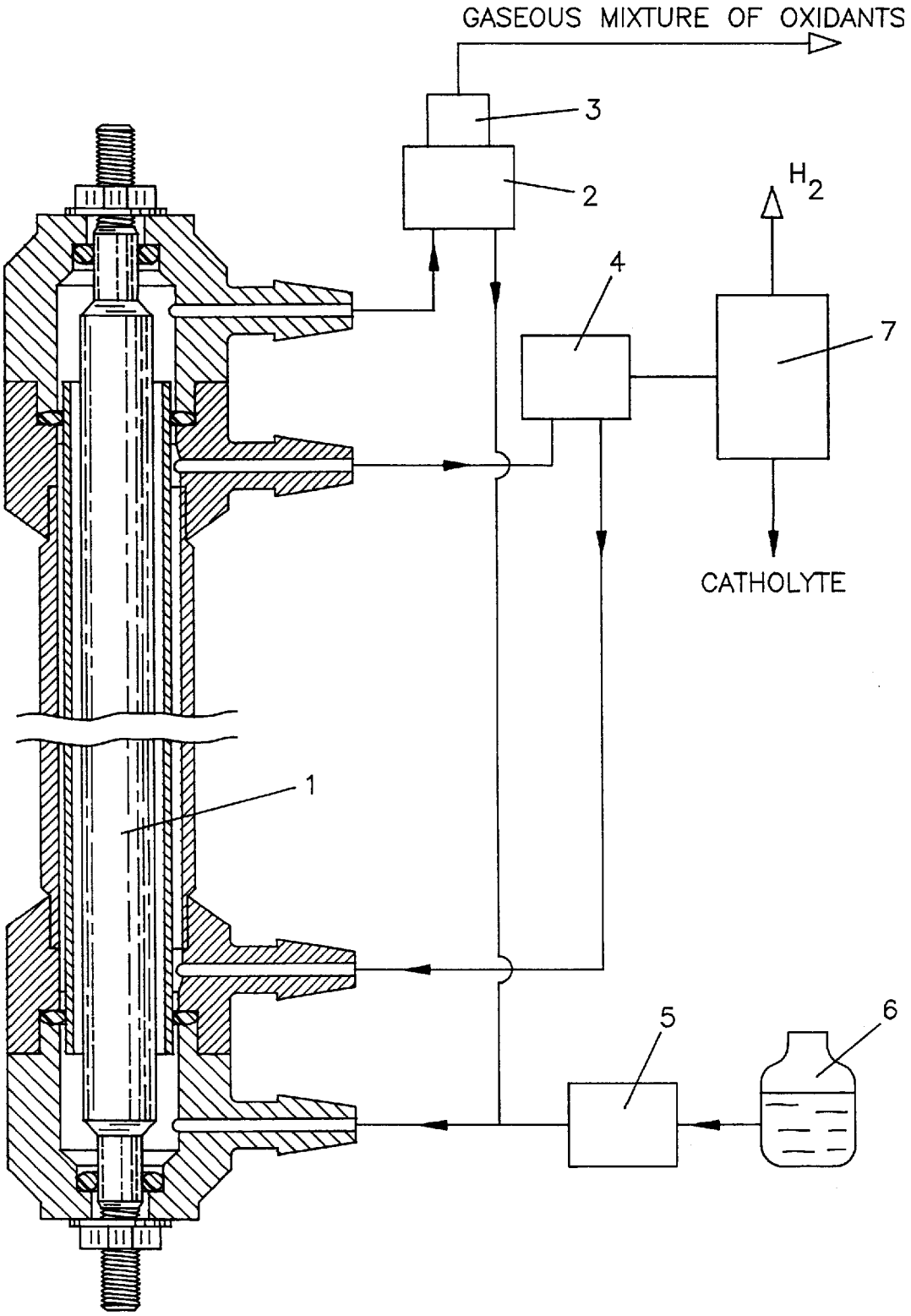
FIG. 1 shows one preferred embodiment of the apparatus of the present invention.
Figure 1A:
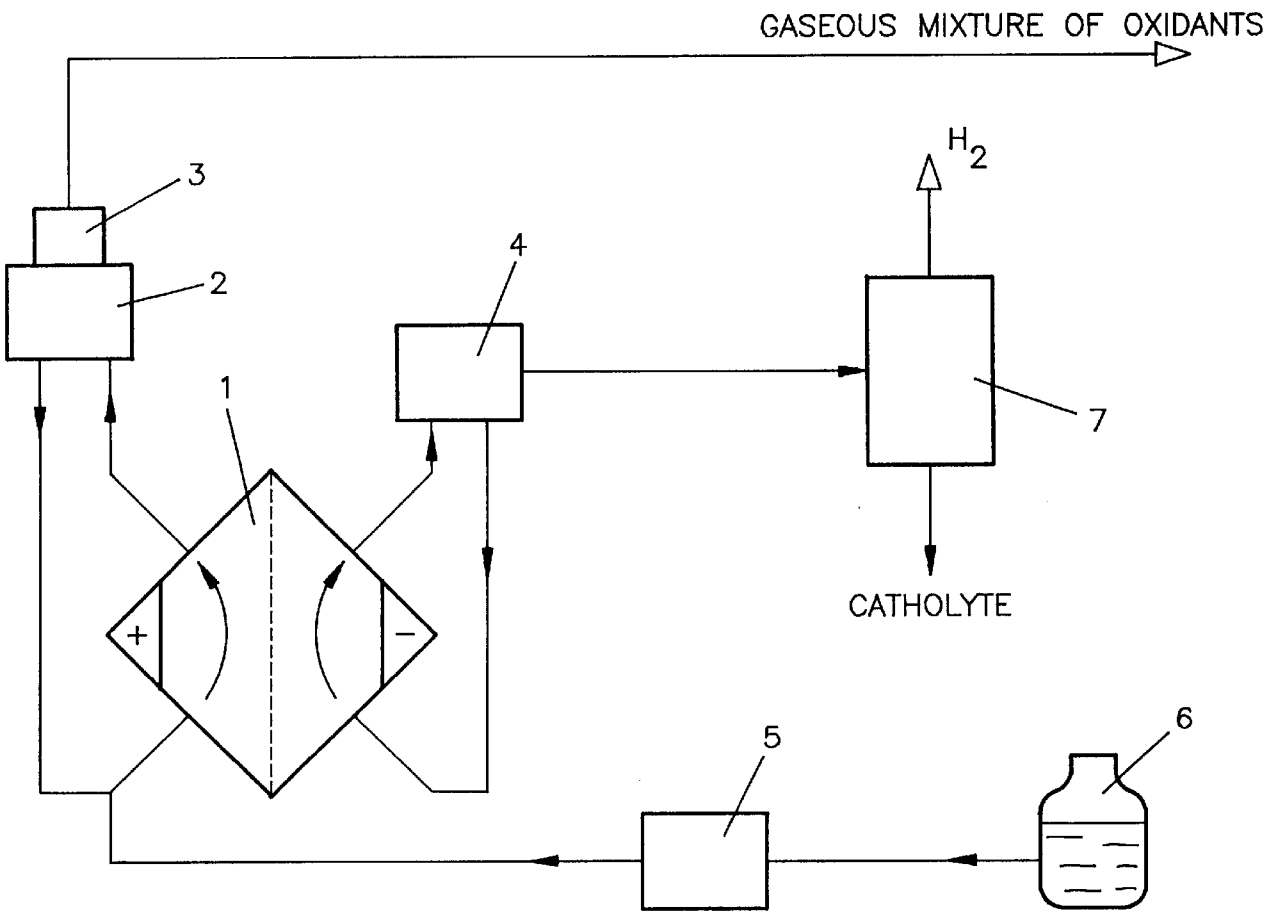
FIG. 1*a* shows a schematic representation of the operation of the apparatus shown in FIG. 1.

With reference to FIG. 1, the apparatus of the present invention comprises an electrochemical cell 1 (or a plurality or block of cells), a reservoir 2 for the anode circulation system which is also provided with a built-in controller for the level of anolyte (not shown on the drawing), a valve-type device 3 for releasing the gaseous mixture of the oxidants to maintain a given pressure in the anode circulation system, a reservoir 4 for the cathode circulation system which also includes a valve-type device for the discharge of the excess gas-liquid mixture (not shown on the drawing), a feed unit 5 which contains a pump and a brine tank 6, connected to the lower part of the anode circulation system and a gas separator 7 for separating hydrogen from the alkaline solution (the catholyte). The built-in controller can be any suitable regulation device that controls the speed at which the brine is pumped into the anode chamber.

Figure 2:
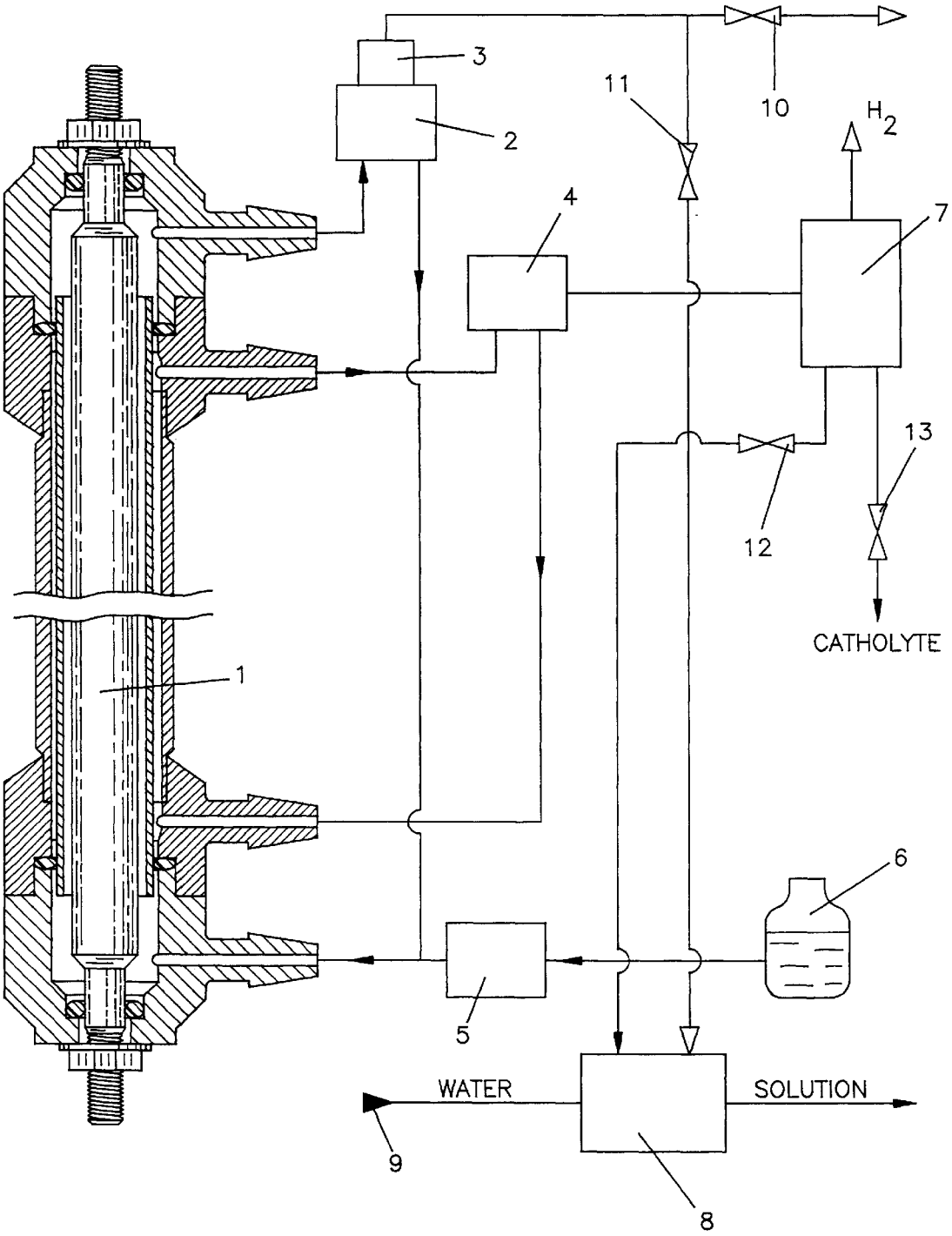
FIG. 2 shows a second preferred embodiment of the apparatus of the present invention.
Figure 2A:
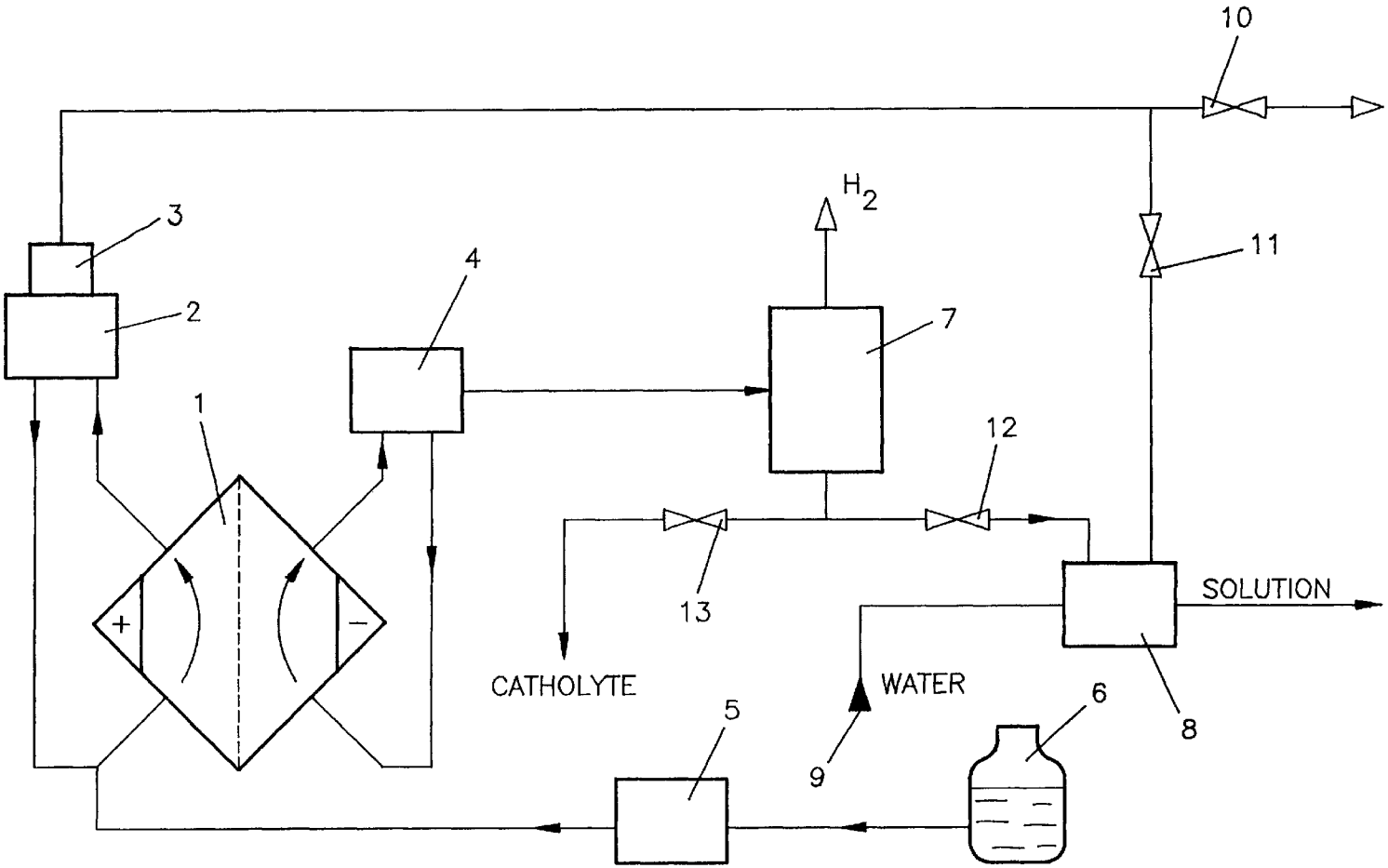
FIG. 2*a* shows a schematic representation of the operation of the apparatus shown in FIG. 2.

As shown in FIG. 2, the apparatus of the present invention can be utilized to obtain a gaseous mixture of oxidants or a water solution of oxidants by dissolving obtained gases in the water with the possibility of pH regulation by adding catholyte. This type of apparatus can be used for the disinfection of polluted water or for water purification.

The apparatus shown in FIG. 2 adds additional structure to that shown in FIG. 1. The reference numerals in FIG. 2 that are the same as those shown in FIG. 1 refer to the same structure. The apparatus of FIG. 2 further includes a blender 8 connected to the source of water 9 to be treated. Special pipe lines are connected to the output of gaseous mixture and to the liquid output of the gas separator 7. The valves 10, 11, 12 and 13 are installed on the special pipe lines. The source water 9 can be clean water (for obtaining water solutions) or polluted water (for use in a process for the purification and disinfection of polluted water).

The apparatus of the present invention works as follows. The cathode circulation system is filled with water. The anode circulation system is filled with the saturated water solution of chloride of alkaline or earth-alkaline metal. After the power is turned on and the process is stabilized, the anode circulation system is started. The brine is fed continuously and very slowly into the lower part of the anode circulation system by means of the feed unit 5. The saturated brine circulates in the anode circulation system due to the gas lift: the released anode gases (chlorine, chlorine dioxide, ozone and oxygen, as the case may be) carry the liquid up to the reservoir 2 where the gases are fractionally separated from the liquid. The gas mixture is removed from the top part of the reservoir 2 by means of the valve-type device 3 and the liquid returns to the inlet of the anode chamber. The pressure in the anode chamber of the reactor is 0.5–1.3 $kgs/cm^2$ higher than the pressure in the cathode chamber. This pressure differential prevents the hydroxide-ions from penetrating from the cathode chamber into the anode chamber and limits the dissolution of the released chlorine in water. Sodium ions penetrate through the diaphragm from the anode chamber into the cathode chamber due to the pressure differential and electric-mass transfer by diffusion. Sodium ions also carry out some amount of water through the diaphragm. Thereby, concentrated alkaline solution (pH>13) is circulated in the cathode chamber by means of the hydrogen gaslift.

The excess of the alkaline solution and released hydrogen are removed from the top part of the reservoir 4 and enter into the gas separator 7 for separation and further utilization.

Salt consumption (saturated brine) is about equal to the amount of solution which is filtered into the cathode chamber through the diaphragm. The conversion rate of salt reaches 95% since the anode process runs in the acid media under the increased pressure.

Each electrochemical cell is given 3–4 volts and 5–7 amperes.

The apparatus can be used in place of the traditional systems for drinking water chlorination in water treatment plants, for swimming pool water disinfection systems and for home, agricultural and industrial sewages water treatment.

The apparatus can also be used for obtaining chlorine water type disinfecting solutions with the concentration of oxidants (mainly oxy-chlorine compounds) ranging from 100 to 1500 ppm. The apparatus for obtaining disinfecting solutions (FIG. 2) contains a blender 8 to dissolve a gaseous mixture of oxidants in water.

Depending on the amount of injected gases, a solution with a pH within 2.8–3.5 and an oxidation reduction potential (OPR) from +1000 mV to +1200 mV and a concentration of the oxidants from 500 to 1300 ppm can be obtained. The mineralization of the obtained solutions exceeds the mineralization of source water on the equivalent amount of dissolved gases.

The pH of the obtained solution may be varied by means of adjusting valve 12 and adjusting valve 13. Increasing the amount of the catholyte delivered from gas separator 7 to the blender 8 through valve 12 (before or after injection of the gaseous mixture) will increase the pH of the solution. The pH of the disinfecting solution can reach 7.0–7.5 if all of the obtained catholyte is added into water.

The invention can be illustrated by the following examples which are not intended to be exhaustive of the present invention. Unless specified otherwise, an ultrafiltration ceramic diaphragm (composition: zirconium oxide—60% mass, aluminum oxide—27% mass, yttrium oxide—3% mass) is used in all examples.

The basic proportions of the main components of a gaseous mixture are: chlorine—70%, chlorine dioxide—20%, ozone—5% and oxygen—5%. These proportions can vary widely depending on the working mode of the apparatus.

EXAMPLE 1

The apparatus contains one cell. The external electrode (cathode) of the cell is made from polished titanium. The internal electrode (anode) is made from titanium coated with ruthenium oxide and titanium oxide. The length of the cathode is 150 mm. The distance between electrodes is 2.9 mm. The diameter of the middle section of the anode is 9.0 mm; the length of the middle section is 156 mm. The diaphragm is a cylinder with a wall thickness of 0.5 mm along its entire length.

The volume of the anode circulation system reservoir is 100 ml. It is installed 250 mm above the anode chamber outlet. The volume of the cathode reservoir is 200 ml and it is installed under the anode capacity.

After the cathode circulation system is filled with water and the anode circulation system is filled with brine (a water solution of sodium chloride with a concentration of 300 g/l), 3.5 Volts and 8 Amperes are applied to the electrodes. After stabilization of the circulation process, the feed unit begins to inject brine. 3.3 liters of gas are obtained containing 60% $Cl_2$, 35% $ClO_2$, 3% $O_3$ and 2% $O_2$. Also obtained are 3.4 liters of hydrogen and 60 ml of alkaline solution with a pH of 14 and a general mineralization 240 g/l. The current efficiency for anode gases formed is 97%.

EXAMPLE 2

Another process is conducted under the same conditions as in example 1, but the cathode of the cell is made from glass carbon. The length of the cathode is 240 mm and the length of the middle section of the anode is 250 mm. The diameter of the middle section is 10 mm. The distance between electrodes is 3 mm. The external surface of the diaphragm is a cylinder and the internal surface of the diaphragm is a cone (conicity value 1:500) with a wall thickness of the upper butt-end of 0.5 mm and the lower butt-end of 0.8 mm. The width of the cathode chamber is constant throughout the length of the cell, but the anode chamber is wider at the top end. The concentration of brine is 300 g/l. The feeding rate is 1 ml/min. The power consumption is 8.2 Amperes DC and 3.3 Volts DC. As a result, 3.6 l/hr of the anode treated gases is obtained. The current efficiency for the anode gases formed is 97.2%.

EXAMPLE 3

Another process was conducted under the same conditions as in example 2, but the external and internal surfaces of the diaphragm are a cone with the conicity value 1:600 and with a wall thickness of the upper butt-end of 0.4 mm and the lower butt-end of 0.7 mm. The volume capacity of the anode circulation system is 70 ml. The volume of the cathode reservoir is 130 ml. The anode reservoir is installed 220 mm above the anode chamber outlet.

The results are as follows: production capacity is 10 grams of oxidants per hour and the specific power consumption on syntheses of the oxidants is 1.3 Watt-hr/g.

Data on using the apparatus of the present invention with differing number of cells (each cell contains cylindrical diaphragms; the length of the cathode is 200 mm; the distance between the electrodes is 3.0 mm and the diameter of the middle section of the anode is 8.0 mm) is presented in the Table 1:

TABLE 1

| | Number of cells | | |
|---|---|---|---|
| PARAMETERS | 10 | 50 | 100 |
| Concentration of sodium chloride in brine, g/l | 300 | 300 | 300 |
| Production capacity, gram oxidants per hour | 100 | 500 | 1000 |
| Production capacity, liters of tap water per hour | 30 000 | 160 000 | 300 000 |
| Consumption of sodium chloride for synthesis of 1 gram oxidants | 2 | 2 | 2 |
| Power consumption, W | 150 | 750 | 1500 |
| Specific power consumption for synthesis of 1 gram oxidants, W*hr/g | 1.5 | 1.5 | 1.5 |
| Weight of the apparatus, kg | 8 | 30 | 60 |

TABLE 1-continued

| PARAMETERS | Number of cells 10 | 50 | 100 |
|---|---|---|---|
| Dimensions of the apparatus, cm | 40 × 30 × 60 | 50 × 40 × 70 | 60 × 70 × 70 |

Figure 3:
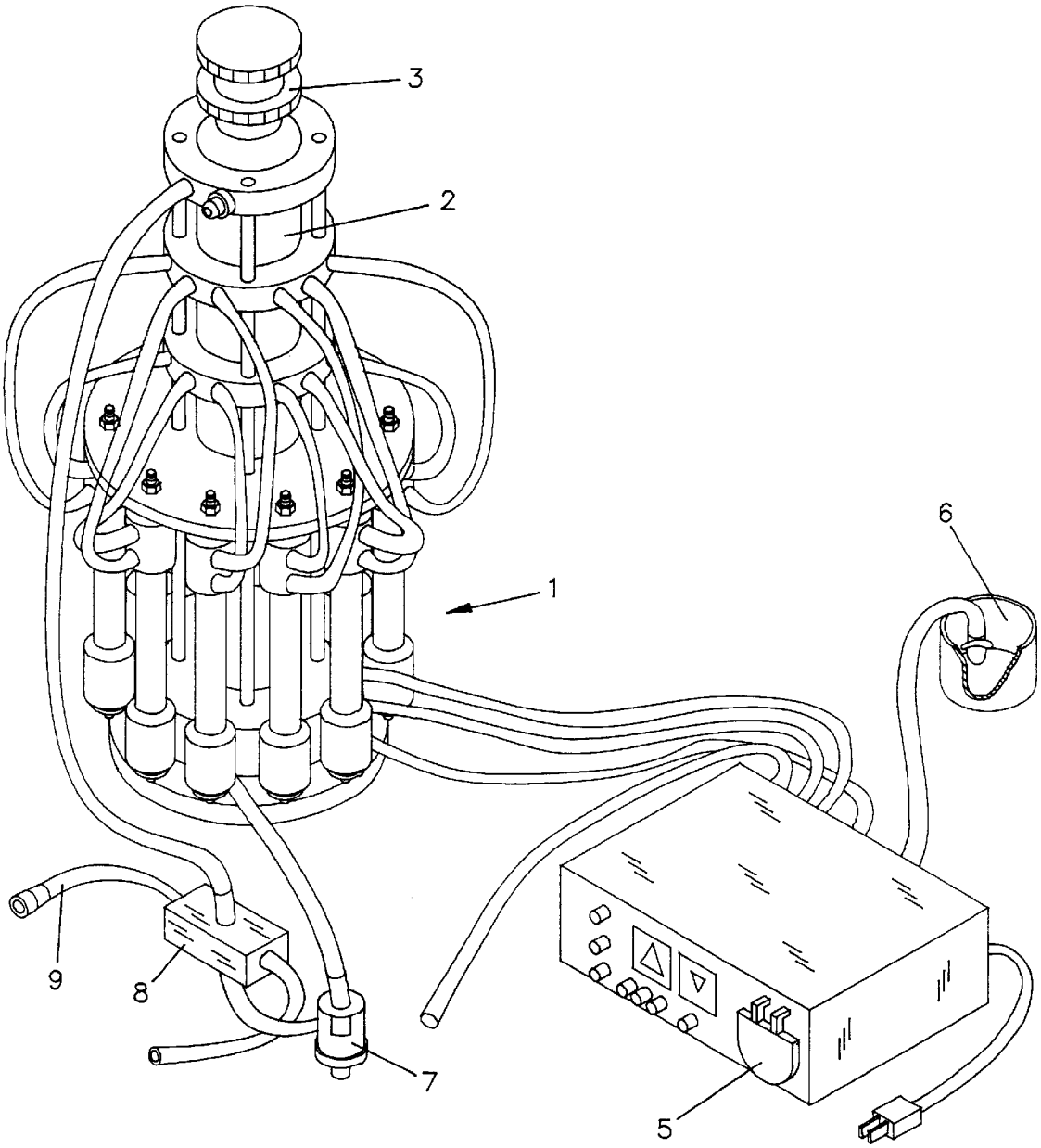
FIG. 3 shows the apparatus of the present invention connected together as group or block of cells.

FIG. 3 shows the apparatus of the present invention configured to have a plurality of electrochemical cells interconnected. With reference to FIG. 3, the apparatus of the present invention comprises a plurality of electrochemical cells 1 which may be configured in any suitable arrangement such as circular as shown. A reservoir 2 for the anode circulation system is interconnected to each of the cells 1. The reservoir also is provided with a built-in controller for the level of anolyte (not shown on the drawing). A valve-type device 3 for releasing the gaseous mixture of the oxidants to maintain a given pressure in the anode circulation system is connected to the reservoir 2. Another reservoir 4 for the cathode circulation system is interconnected to each of the cells 1 and reservoir 4 also includes a valve-type device for the discharge of the excess gas-liquid mixture (not shown on the drawing). A feed unit 5 which contains a pump and has a brine tank 6 connected thereto is connected to the lower part of the anode circulation system in each of the cells. A gas separator 7 for separating hydrogen from the alkaline solution (the catholyte) is also connected to each of the cells 1. The built-in controller can be any suitable regulation device that controls the speed at which the brine is pumped into the anode chamber.

As also shown in FIG. 3, the apparatus may further include a blender 8 connected to the source of water 9 to be treated in the manner described above in connection with the apparatus shown in FIG. 2.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. An apparatus for obtaining products by anode oxidation of dissolved chlorides of alkaline or alkaline-earth metals comprising:

a) an electrochemical cell comprising a vertical cylindrical internal electrode functioning as an anode and having an inlet and an outlet, a vertical cylindrical external electrode functioning as a cathode having an inlet and an outlet and mounted coaxially around the internal electrode so as to provide an inter-electrode space therebetween and a coaxial ceramic diaphragm mounted in the inter-electrode space so as to create an anode chamber between the anode and the diaphragm and a cathode chamber between the diaphragm and the cathode;

b) an anode circulation system connected to the inlet and the outlet of the anode chamber and including a reservoir therein, the reservoir including means for controlling the level of anolyte in the anode chamber;

c) a valve mounted to the reservoir for releasing a gaseous mixture of oxidants to maintain a given pressure in the anode circulation system;

d) a cathode circulation system connected to the inlet and the outlet of the cathode chamber and including a reservoir therein, the reservoir including means for controlling the level of catholyte in the cathode chamber;

e) a water source and a feed unit including a pump and a brine tank connected to the inlet of the anode circulation system; and f) a gas separator including a gaseous output and a liquid output for separating hydrogen from the catholyte.

2. An apparatus for obtaining products by anode oxidation of dissolved chlorides of alkaline or alkaline-earth metals comprising:

a) at least one electrochemical cell comprising a vertical cylindrical internal electrode functioning as an anode and having an inlet and an outlet, a vertical cylindrical external electrode functioning as a cathode having an inlet and an outlet and mounted coaxially around the internal electrode so as to provide an inter-electrode space therebetween and a coaxial ceramic diaphragm mounted in the inter-electrode space so as to create an anode chamber between the anode and the diaphragm and a cathode chamber between the diaphragm and the cathode;

b) an anode circulation system connected to the inlet and the outlet of the anode chamber and including an anode reservoir therein with the anode reservoir being located at a height above the electrochemical cell at a distance from the anode chamber outlet between 0.5 and 2.0 times the length of the anode chamber, the volume of the anode reservoir being in a range from 20 to 100 times the volume of the anode chamber of the electrochemical cell, and the anode reservoir including means for controlling the level of anolyte in the anode chamber;

c) a valve mounted to the reservoir for releasing a gaseous mixture of oxidants to maintain a given pressure in the anode circulation system;

d) a cathode circulation system connected to the inlet and the outlet of the cathode chamber and including a cathode reservoir therein with the cathode reservoir being located between the cathode chamber outlet and the anode reservoir of the anode circulation system, the volume of the cathode reservoir being in a range from 30 to 200 times the volume of the cathode chamber of the electrochemical cell, the cathode reservoir including means for controlling the level of catholyte in the cathode chamber;

e) a water source and a feed unit including a pump and a brine tank connected to the inlet of the anode circulation system;

f) the cathode reservoir including a connecting pipe attached to an upper portion of the cathode chamber for discharging liquid and gaseous products from the cathode chamber; and g) a gas separator including a gaseous output and a liquid output and attached to the connecting pipe of the cathode reservoir for separating hydrogen from the catholyte.

3. The apparatus of claim 2 further comprising a blender connected to the water source by special lines each of which contain an adjusting valve and the blender also connected to the liquid output of the gas separator and to each of the adjustment valves for releasing the electrolytic gases from the anode reservoir.

4. The apparatus of claim 2 further including facilities for parallel hydraulic joining a plurality of electrochemical cells.

5. The apparatus of claim 4 in which the volume of the anode reservoir is in a range from 20 to 100 times the total volume of the anode chambers of the plurality of electrochemical cells and the volume of the cathode reservoir is in a range from 30 to 200 times the total volume of the cathode chambers of the plurality of electrochemical cells.

* * * * *